US008584993B2

(12) United States Patent
Pumford et al.

(10) Patent No.: US 8,584,993 B2
(45) Date of Patent: Nov. 19, 2013

(54) COLUMN AND HINGE ASSEMBLIES THEREFOR

(75) Inventors: Alexandra Pumford, Cardiff (GB); Craig Thomas Williams, North Gower (GB); Mark Alan Edwards, Port Talbot (GB)

(73) Assignee: The Aluminum Lighting Company Limited, Cymmer (GB)

( * ) Notice: Subject to any disclaimer, the term of this patent is extended or adjusted under 35 U.S.C. 154(b) by 931 days.

(21) Appl. No.: 10/592,485

(22) PCT Filed: Mar. 3, 2005

(86) PCT No.: PCT/GB2005/000807

§ 371 (c)(1),
(2), (4) Date: Jun. 21, 2007

(87) PCT Pub. No.: WO2005/088035

PCT Pub. Date: Sep. 22, 2005

(65) Prior Publication Data

US 2007/0294962 A1 Dec. 27, 2007

(30) Foreign Application Priority Data

Mar. 11, 2004 (GB) ..... 0405486.2
Nov. 26, 2004 (GB) ..... 0426113.7

(51) Int. Cl.
*A47G 23/02* (2006.01)

(52) U.S. Cl.
USPC ..... 248/150; 248/291.1; 248/292.13; 248/183.3; 135/74; 135/20.1; 403/100; 403/102; 52/113; 16/254; 16/255; 16/262

(58) Field of Classification Search
USPC ..... 248/150, 548, 900, 291.1, 292.11, 248/292.13, 183.1, 184.1, 183.2, 183.3, 248/185.1, 289.11, 289.31, 417, 550, 600, 248/514, 577, 279.1; 16/254, 255, 257, 16/262, 270, 280, 306, 256, 258, 277, 281, 16/239, 285; 52/113, 116; 135/74, 20.1; 403/100, 102, 66, 72, 85, 93
See application file for complete search history.

(56) References Cited

U.S. PATENT DOCUMENTS 107,213 A * 9/1870 Rankin ..... 5/241
257,373 A * 5/1882 O'Lally ..... 16/281

(Continued)

FOREIGN PATENT DOCUMENTS

DE 197 25 081 A1 10/1998
EP 0 288 204 10/1988

(Continued)

*Primary Examiner* — Kimberly Wood
(74) *Attorney, Agent, or Firm* — Westman, Champlin & Koehler, PA; Z. Peter Sawicki

(57) ABSTRACT

A column includes a hinge assembly, the hinge assembly having an upper portion (2) pivotally attached to a lower portion (1) for movement about a first pivot axis (5), the upper portion of the hinge assembly being associated with an upper part (12) of the column and the lower portion of the hinge assembly being associated with a lower part (11) of the column. In use, movement of the upper and lower hinge assembly portions about the first pivot axis from a normal position, in which the upper part of the column is relatively upright, causes the upper part of the column to rotate towards the lower part of the column, thereby allowing the upper part the column to be moved to a maintenance position. An arm links (3), via second (6) and third (7) pivot axes, the upper and lower portions of the hinge assembly, and the arm is associated with a spring (9) that exerts a force via the arm, which urges the upper and lower hinge assembly portions towards the normal position.

29 Claims, 5 Drawing Sheets

(56) References Cited

U.S. PATENT DOCUMENTS

| | | | | | |
|---|---|---|---|---|---|
| 503,064 | A | * | 8/1893 | Robinson | 16/280 |
| 738,554 | A | * | 9/1903 | Lingel | 135/74 |
| 911,636 | A | * | 2/1909 | Whitlock | 135/22 |
| 949,949 | A | * | 2/1910 | Williamson | 16/281 |
| 1,036,222 | A | | 8/1912 | Griffenberg | |
| 1,102,863 | A | * | 7/1914 | Bojas | 81/177.75 |
| 1,743,241 | A | * | 1/1930 | Schmidt | 74/473.33 |
| 2,038,045 | A | * | 4/1936 | Heiser | 160/70 |
| 2,286,655 | A | | 6/1942 | Supnick | |
| 2,352,565 | A | | 6/1944 | Ranson | |
| 2,437,192 | A | * | 3/1948 | Glanz | 16/50 |
| 2,441,689 | A | * | 5/1948 | Daniel | 135/74 |
| 2,645,511 | A | | 7/1953 | Rutledge | |
| 2,649,104 | A | * | 8/1953 | Militano | 135/74 |
| 2,721,569 | A | * | 10/1955 | Militano | 135/20.3 |
| 3,112,514 | A | * | 12/1963 | Ostrom | 16/289 |
| 3,150,671 | A | * | 9/1964 | Frey | 135/20.3 |
| 3,204,287 | A | * | 9/1965 | Gronbach | 16/288 |
| 3,209,392 | A | * | 10/1965 | Levine | 16/289 |
| 4,314,319 | A | | 2/1982 | Terry et al. | |
| 4,615,637 | A | * | 10/1986 | Pelischek | 403/85 |
| 4,858,802 | A | * | 8/1989 | Hamby et al. | 224/406 |
| 4,865,064 | A | | 9/1989 | Parsons et al. | |
| 5,539,957 | A | | 7/1996 | Schmidt | |
| 5,746,533 | A | | 5/1998 | Schmidt | |
| 5,806,549 | A | | 9/1998 | Love | |
| 6,241,630 | B1 | * | 6/2001 | Alberti | 473/492 |
| 6,575,182 | B2 | * | 6/2003 | Tung | 135/20.1 |
| 6,622,741 | B2 | * | 9/2003 | Lai | 135/20.3 |
| 6,625,847 | B1 | * | 9/2003 | Jones | 16/51 |
| 6,810,892 | B2 | * | 11/2004 | Lai | 135/20.3 |
| 7,367,376 | B2 | * | 5/2008 | Llagostera | 160/66 |
| 2003/0086752 | A1 | | 5/2003 | LeMole | |
| 2004/0036222 | A1 | | 2/2004 | Chou | |

FOREIGN PATENT DOCUMENTS

| | | | |
|---|---|---|---|
| EP | 0 325 311 | | 7/1989 |
| GB | 544620 | | 4/1942 |
| GB | 968113 | | 8/1964 |
| GB | 2 362 396 | | 11/2001 |
| JP | 63 067421 | | 3/1988 |
| WO | WO 03/029581 | A3 | 4/2003 |
| WO | WO 03/105575 | A3 | 12/2003 |

* cited by examiner

Figure 4A
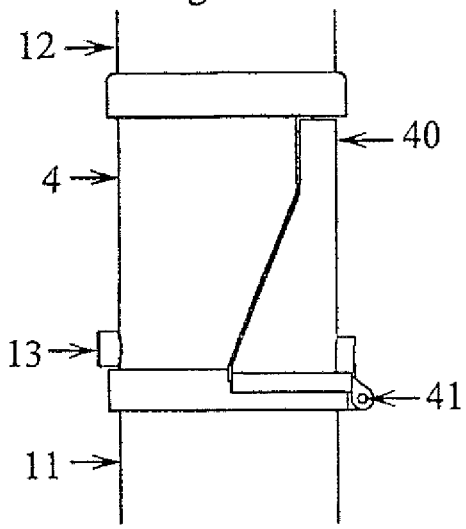
Figure 4B
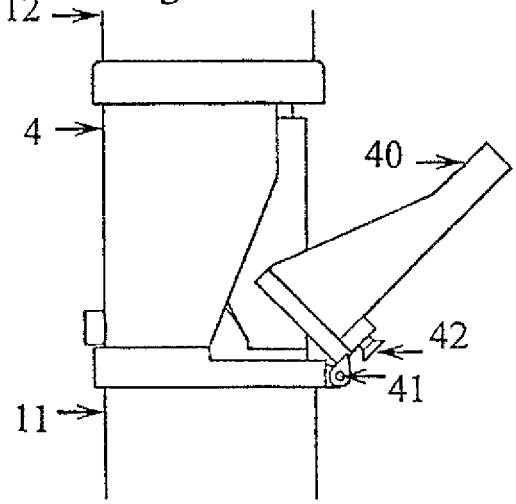
Figure 4C
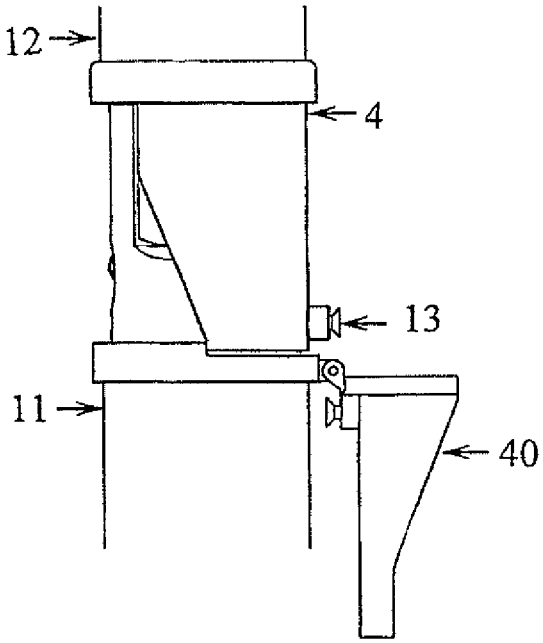
Figure 4D
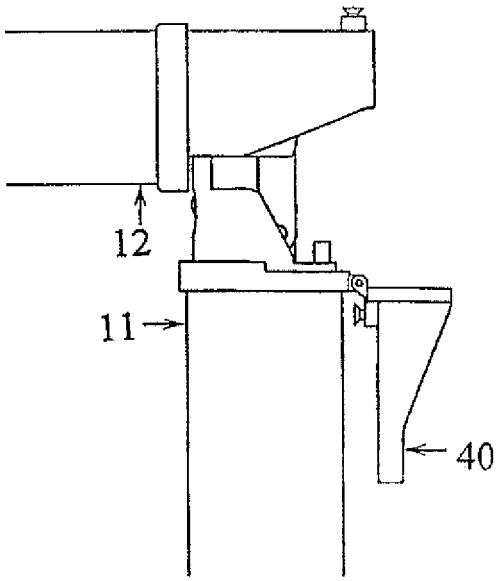
Figure 4

COLUMN AND HINGE ASSEMBLIES THEREFOR

BACKGROUND OF THE INVENTION

The present invention relates to hinged columns, in particular but not exclusively lampposts, and hinge assemblies for use in such columns.

Most lampposts or similar columns are in the form of a rigid column supporting a load, such as a lamp or camera. When the lamp fails it has to be replaced or repaired and access to the top of the column is required. Where there is access by road a sky-lift can be used but in confined spaces access may only be possible by climbing a ladder. Recently the UK Health and Safety Executive has recommended against the use of ladders to service lampposts because there have been numerous accidents when workmen lean a ladder against a lamppost which is corroded and subsequently collapses.

The raise and lower type of post has been developed to address such problems. This is a post with a hinge positioned above, but accessible from, the ground, and arranged so that the main body of the post can be tilted such that the end of the post and the lamp may be readily accessed by a worker standing on the ground.

Such posts generally comprise lower and upper portions mutually attached by a hinge. Several mechanisms have been used to lower and raise the upper portion. One mechanism is to attach a rope or cord to the upper portion, the operator holding the rope and lowering and raising the upper portion as desired. This relies on the strength and control of the operator to lower and raise the upper portion safely. This is an intrinsically unsafe method. A further known mechanism is to provide a piston which is attached externally to the post, with one end removably attached below the hinge and the other end being removably attached above the hinge such that the piston acts to control and slow the fall of the upper portion once the hinge is broken. This relies on a piston unit being transported to each post. Alternatively, a spring arrangement may be provided inside the post to control the movement of the upper portion of the post.

Some of these prior art devices (such as U.S. Pat. No. 2,645,511 and WO03029581) use chains to connect the upper portion of the post to a spring arrangement. The applicant has found that chains are complex and often comprise weak regions or links. Other coupling arrangements have been suggested, such as that described in GB2362396, wherein the upper portion of the post is directly connected to a yoke bearing a rod that exerts pressure onto a spring. A housing containing the rod and spring is permitted to pivot to facilitate the movement of the housing. Such an arrangement is complicated and unwieldy.

Many raise to lower posts are provided with safety devices that are used to prevent unauthorised or unwanted activation of the hinging mechanism. WO03029581 discloses a mechanism to lock the upper portion and lower portion together so as to prevent motion about the hinge when the post is upright or when the upper portion is fully lowered for maintenance or replacement of the lamp. U.S. Pat. No. 2,645,511 discloses a raise to lower post with a lockable door that prevents unauthorised or unwanted tilting; the door may be removed to allow tilting to occur. The door, however, is detached from the post to allow tilting, resulting in possible loss and/or accidental damage of the door. Furthermore, once the bolt has been removed from the door, then unwanted or accidental removal of the door may occur all too readily.

The column of the present invention mitigates against some or all of these problems.

SUMMARY OF THE INVENTION

In accordance with a first aspect of the present invention there is provided a column comprising a hinge assembly, the hinge assembly comprising an upper portion pivotally attached to a lower portion for movement about a first pivot axis, the upper portion of the hinge assembly being associated with an upper part of the column and the lower portion of the hinge assembly being associated with a lower part of the column, wherein in use, movement of the upper and lower hinge assembly portions about the first pivot axis from a normal position, in which the upper part of the column is relatively upright, causes the upper part of the column to rotate towards the lower part of the column, thereby allowing the upper part of the column to be moved to a maintenance position, a connecting means links, via second and third pivot axes, the upper and lower portions of the hinge assembly, and the connecting means is associated with a bias means that exerts a force via the connecting means, which urges the upper and lower hinge assembly portions towards the normal position.

This provides an effective and simple hinge arrangement that allows controlled lowering of the column from a normal position to a maintenance position and allows controlled raising of the column from the maintenance position to the normal position.

The connecting means (such as a single elongate linking arm) may for example be connected to the upper portion of the hinge assembly by the second pivot axis. The connecting means may be connected via the third pivot axis to a rod. The rod may be slidably mounted in, or otherwise associated with, the lower portion of the hinge assembly. The rod is preferably resiliently mounted, for example by means of a spring that forms a part of the bias means. The rod may for example be provided with a plate that abuts against one end of a spring, holding the spring in compression (the other end of the spring abutting against some other part of the hinge assembly or column, for example abutting against a part of the lower hinge assembly portion), which thus urges the upper and lower hinge assembly portions towards the normal position.

Alternatively, the connecting means (such as a single elongate linking arm) may be connected to the lower portion of the hinge assembly by the second pivot axis and to a resiliently mounted rod by the third pivot axis. The rod may be provided with a plate that abuts against one end of a spring, holding the spring in compression (the other end of the spring abutting against some other part of the hinge assembly or column, for example abutting against a part of the upper hinge assembly portion), which thus urges the upper and lower hinge assembly portions towards the normal position.

The upper hinge assembly portion may be provided with a longitudinally extending, elongate column member, for example a tubular metal pole that carries a lamp, camera or the like. The lower hinge assembly portion may be provided with a longitudinally extending, elongate column member such as a tubular metal pole suitable for forming the base of a lamppost.

It is preferred that the first, second and third pivot axes are substantially mutually parallel. This provides a simple and convenient linking arrangement.

It is preferred that the connecting means may comprise a substantially rigid link pivotally attached via a first pivotal attachment, for pivoting movement about the second pivot axis, to one of the upper hinge assembly portion and the lower hinge assembly portion, and the link is provided with a second pivotal attachment for pivoting movement about the third pivot axis.

It is preferred that the link is elongate and is pivotally attached to one of the upper hinge assembly portion and the lower hinge assembly portion at or near one end of the link, and the link is provided with the second pivotal attachment at or near the other end of the link.

The substantially rigid link is preferably connected via the second pivotal attachment to an engagement member that engages with the bias means such that the bias means exerts a force via the engagement member and the connecting means, which urges the upper and lower hinge assembly portions towards the normal position.

It is preferred that the connecting means comprises a substantially rigid link, the substantially rigid link being pivotally attached, via a first pivotal attachment for pivoting movement about the second pivot axis, to one of the upper hinge assembly portion and the lower hinge assembly portion, and being pivotally attached, via a second pivotal attachment for pivoting movement about the third pivot axis, to an engagement member associated with the other of the upper hinge assembly portion and the lower hinge assembly portion, the engagement member engaging with the bias means such that the bias means exerts a force via the engagement member and the connecting means, which urges the upper and lower hinge assembly portions towards the normal position.

It is preferred that the second pivot axis is associated with the upper hinge assembly portion and the third pivot axis is associated with the lower hinge assembly portion.

The engagement member is preferably rigid and is preferably elongate. It is preferred that the engagement member is movable such that, in use, movement of the column in a direction from its normal position to the maintenance position causes movement of the engagement member so as to increase the force which urges the upper and lower hinge assembly portions towards the normal position. It is further preferred that the engagement member is movable in a direction substantially parallel to the longitudinally extending axis of the column in the upright position. In the case that the engagement member is elongate, then it is preferred that the bias means comprises a helical spring. It is preferred that at least part of the engagement member is disposed within the cavity formed by the helix of the helical spring. The engagement member may be in the form of a rod and the engagement member may be provided with abutment means that engages with one end of the helical spring so as to cause the spring to be compressed for at least part of the time when, in use, the column is moved from the normal to the maintenance position. The abutment means is usually provided remote from the second pivotal attachment. It is preferred that the spring is compressed for all positions of the column. It is further preferred that the magnitude of compression, in use, increases when the column is moved from the normal position to the maintenance position.

Such a single link provides a strong and reliable connection between the upper portion of the hinge assembly and the bias means.

In one embodiment, the connecting means may comprise a substantially rigid link, the substantially rigid link being pivotally attached, via a first pivotal attachment for pivoting movement about the second pivot axis, to one of the upper hinge assembly portion and the lower hinge assembly portion, and being pivotally attached, via a second pivotal attachment for pivoting movement about the third pivot axis, to the bias means. In this case, the bias means may be a tension spring.

It is preferred that the second pivot axis is associated with the upper hinge assembly portion and the third pivot axis is associated with the lower hinge assembly portion.

One or both of the upper and lower hinge assembly portions may be adapted to enable the position of the upper hinge assembly portion to be fixed relative to the lower hinge assembly portion. It is preferred that one or more of the links may be adapted such that the said links may co-operate with one or both of the upper and lower hinge assembly portions to enable the position of the upper hinge assembly portion to be fixed relative to the lower hinge assembly portion. It is preferred that one or more of the links may be adapted such that the said links may co-operate with one or both of the upper and lower hinge assembly portions to enable the position of the upper hinge assembly portion to be fixed relative to the lower hinge assembly portion in one of a plurality of predetermined positions. This may be achieved by providing one or more links with a bore therethrough for accommodating a longitudinally extending member. Such a member may be inserted through a bore provided in one or both of the upper and lower hinge assembly portions. In this manner, the longitudinally extending member may penetrate through the bore provided in one or both of the upper and lower hinge assembly portions and into the bore provided in the respective link. Such an arrangement is convenient and allows the longitudinally extending member to be accessed from the front of the hinge assembly. Furthermore, it is anticipated that this arrangement allows access to and changing of the spring. It is preferred that the longitudinal axis of the longitudinally extending member is, in use, substantially perpendicular to the axis of the pivotal attachment between the upper and lower hinge assembly portions.

It is preferred that if the connecting means comprises a substantially rigid link, then the link is provided with a bore therethrough for accommodating a longitudinally extending member so that the position of the upper hinge assembly portion may be fixed relative to the lower hinge assembly portion in one of a plurality of predetermined positions.

If the connecting means comprises a substantially rigid link pivotally attached to one of the lower hinge assembly portion and the upper hinge assembly portion, and the link is provided with a second pivotal attachment, then it is preferred that the link is provided with a plurality of mutually spaced bores. If the link is elongated, then it is preferred that the bores are mutually spaced in a direction corresponding to the longitudinal axis of the link. Each bore corresponds to a position in which the upper hinge assembly portion may be fixed relative to the lower hinge assembly portion.

It is preferred that the connecting means and the bias means (and optionally the engagement member, if present) are, when the column is in the normal position, disposed within a cavity formed by the column. This may typically be achieved by providing a column that is formed from hollow, tubular members.

The hinge assembly may further comprise a cover that is movable between a first cover position in which the cover inhibits pivotal motion of the upper hinge assembly portion relative to the lower hinge assembly portion and a second cover position in which the upper hinge assembly portion may move pivotally relative to the lower hinge assembly portion. It is preferred that the cover is attached to, and preferably in intimate contact with, one or both of the upper and lower hinge assembly portions in the first and second cover positions. This allows the cover to be retained on the column therefore ensuring that the cover should not be separated from the remainder of the column, thus allowing the possibility of the cover being lost or damaged. It is further preferred that the cover is attached to, and more preferably in intimate contact with, one or both of the upper and lower hinge assembly portions during movement between the first and second cover positions.

The cover may be slidable between the first and second cover positions. This provides a convenient way of moving the cover.

The cover may be rotatable between the first and second cover positions about the longitudinal axis of the upper and lower hinge assembly portions when the column is in the normal position. The cover may be rotatable between the first and second cover positions about a generally vertical axis. This further provides a convenient way of moving the cover. In this case, it is preferred that the cover is rotatable in only one direction from the first cover position to the second cover position. The cover may be rotatable for about 180° between the first cover position and the second cover position.

The cover may be translatable in a direction substantially parallel to the longitudinal axes of the upper and lower hinge assembly portions when the column is in the normal position. The cover may be translatable either up or down when the column is in the normal position. This allows the cover to be moved away from a hinged joint so that the upper hinge assembly portion may be moved relative to the lower hinge assembly portion.

It is preferred that the hinge assembly comprises means for retaining the cover in one or both of the first and second cover positions. A means for retaining the cover in the first cover position may comprise a bolt. This provides protection against unwanted moving of the cover. A means for retaining the cover in the second cover position may comprise a means for frictionally engaging with the cover. This may, for example, be provided by a groove in which an edge of the cover is frictionally held. Such frictional engagement provides a simple and effective means of holding the cover without the need, for example, for using a bolt that may be time-consuming and possibly difficult to fit and/or release.

The cover is preferably a sleeve that is disposed around at least part of one or both of said upper and lower hinge assembly portions in both the first and second cover positions. The sleeve is preferably shaped to have a cut-away portion that, when sleeve is in the second cover position, permits the movement of the column from the normal to the maintenance position.

The column may further comprise a shield member that, in a first shield member position, inhibits access to at least part of the cover when the cover is in the first cover position so as to resist unwanted removal of, or damage to, the cover.

The shield member may, in the first shield member position, enclose at least part of the cover.

It is preferred that when the shield member is in the first shield member position, the cover is not movable from the first cover position to the second cover position. This provides extra security against unwanted movement of the cover.

It is preferred that the shield member is movable to a second shield member position in which the cover is movable from the first cover position to the second cover position.

The shield member may be provided with a means for locking the shield member in one or both of the first and second shield member positions.

The shield member may be shaped such that, in the first shield member position, the cover and shield member cooperate together to extend circumferentially around at least part of one or both of the upper and lower hinge assembly portions. This may provide a secure structure that is resistant against tampering and vandalism.

The cover may comprise a sleeve with a cut-out portion, the shield member shaped so as to compliment the shape of said cut-out portion. This is advantageous, especially when such a cover is rotatable between the first and second cover positions. The complimentary shape of the shield member helps resist against tampering and vandalism.

If the cover is provided with an edge or edges, then the shield member may, in the first shield member position, inhibit access to at least part of the said edge or edges of the cover. The shield member may be provided with shield member edges that abut against or are directly adjacent to said cover edge or edges so as to inhibit access to said cover edge or edges. It is preferred in this case that the cover and shield member together in the first shield member position form a substantially cylindrical structure.

The shield member may be pivotally mounted to one of the upper and lower hinge assembly portions, preferably the lower hinge assembly portion, so as to undergo a pivotal motion between the first and second shield member positions. The shield member may pivot about an axis substantially parallel to said first pivot axis.

It is further preferred that the hinge assembly comprises an additional means for inhibiting the pivotal motion of the upper hinge assembly portion relative to the lower hinge assembly portion. This may comprise a locking pin or bolt that is inserted, for example, in bores provided in the upper and lower hinge assembly portions so as to inhibit movement. Such an additional means ensures that the upper hinge assembly portion does not accidentally or spontaneously move as soon as the sleeve is moved into the second position.

It is preferred that the bias means is adapted such that, in use, movement of the column from the normal position to the maintenance position causes an increase in the force urging the upper and lower hinge portions into the normal position.

The upper hinge assembly portion may be integral with the upper part of the column, and the lower hinge assembly portion may be integral with the lower part of the column.

In accordance with the second aspect of the present invention there is provided a hinge assembly suitable for use in the column of the first aspect of the present invention. The hinge assembly may incorporate the features described above with respect to the column of the first aspect of the present invention.

It is therefore clear that the upper and lower hinge assembly portions do not have to be an integral part of any longitudinally extending members that make up a column. For example, the upper and lower hinge assembly portions may comprise tubular inserts that may be attached to longitudinally extending members. The lower hinge assembly portion may, for example, be attached to the lower section of a lamppost and the upper hinge assembly portion may be attached to the upper section of a lamppost. This allows one to convert an unhinged column into a hinged one.

The column of the first aspect of the present invention may form an item of street furniture, such as a lamp post.

In accordance with a third aspect of the present invention there is provided a column comprising a hinge assembly, the hinge assembly comprising an upper portion pivotally attached to a lower portion for movement about a first pivot axis, the upper portion of the hinge assembly being associated with an upper part of the column and the lower portion of the hinge assembly being associated with a lower part of the column, wherein in use, movement of the upper and lower hinge assembly portions about the first pivot axis from a normal position, in which the upper part of the column is relatively upright, causes the upper part of the column to rotate towards the lower part of the column, thereby allowing the upper part of the column to be moved to a maintenance position, the hinge assembly includes a cover movable between a first cover position in which the cover impairs pivotal motion of the upper and lower hinge assembly portions about the first pivot axis and a second cover position in which the upper hinge assembly portion may move pivotally relative to the lower hinge assembly portion about the first pivot axis, and the cover is attached to one or both of the upper and lower hinge assembly portions in the first cover position.

It is preferred that the cover is attached to one or both of the upper and lower hinge assembly portions in the first and second cover positions. This prevents accidental loss of the cover and subsequent possible accidental damage.

This provides a security measure for a hinged column in that the column cannot be broken when the cover is in a particular position.

It is preferred that the cover is in intimate contact with one or both of the upper and lower hinge assembly portions in the first and second cover positions. This allows simple storage of the cover in the second cover position.

It is preferred that the cover is attached to, and more preferably in intimate contact with, one or both of the upper and lower hinge assembly portions throughout its movement from the first to the second cover position. Furthermore, the use of a cover that is always mounted on the column ensures that the cover cannot, during normal use, possibly become detached from the column and accidentally lost or damaged.

The upper and lower portions of the hinge assembly may be components of a separately provided assembly that may be fitted to the upper and lower parts of the column, respectively, in order to provide a hinged column. The upper and lower hinge assembly portions may also be integral with sections of column, there being no separate assembly parts used to convert the column to a hinged column.

The cover may be slidable between the first and second cover positions. This provides a convenient way of moving the cover.

The cover may be rotatable between the first and second cover positions about the longitudinal axis of the upper and lower hinge assembly portions when the column is in the normal position. The cover may be rotatable between the first and second cover positions about a generally vertical axis. This further provides a convenient way of moving the cover. In this case, it is preferred that the cover is rotatable in only one direction from the first cover position to the second cover position. The cover may be rotatable for about 180° between the first cover position and the second cover position. The cover may be translatable in a direction substantially parallel to the longitudinal axes of the upper and lower hinge assembly portions when the column is in the normal position (for example in an unbroken orientation). The cover may be translatable either up or down when the column is in the normal position. This allows the cover to be moved away from a hinged joint so that the upper hinge assembly portion may be moved relative to the lower hinge assembly portion.

It is preferred that the column comprises means for retaining the cover in one or both of the first and second cover positions. A means for retaining the cover in the first cover position may comprise a bolt. This provides protection against unwanted moving of the cover. A means for retaining the cover in the second cover position may comprise a means for frictionally engaging with the cover. This may, for example, be provided by a groove in which an edge of the cover is frictionally held. Such frictional engagement provides a simple and effective means of holding the cover without the need, for example, for using a bolt that may be time-consuming and possibly difficult to fit and/or release.

It is preferred that the cover comprises a sleeve that is disposed around at least part of one or both of said upper and lower hinge assembly portions in both the first and second cover positions. The sleeve is preferably shaped to have a cut-away portion that, when sleeve is in the second cover position, permits the movement of the column from the normal to the maintenance position.

The column may further comprise a shield member that, in a first shield member position, inhibits access to at least part of the cover when the cover is in the first cover position so as to resist unwanted removal of, or damage to, the cover.

The shield member may, in the first shield member position, enclose at least part of the cover.

It is preferred that when the shield member is in the first shield member position, the cover is not movable from the first cover position to the second cover position. This provides extra security against unwanted movement of the cover.

It is preferred that the shield member is movable to a second shield member position in which the cover is movable from the first cover position to the second cover position.

The shield member may be provided with a means for locking the shield member in one or both of the first and second shield member positions.

The shield member may be shaped such that, in the first shield member position, the cover and shield member cooperate together to extend circumferentially around at least part of one or both of the upper and lower hinge assembly portions. This may provide a secure structure that is resistant against tampering and vandalism.

The cover may comprise a sleeve with a cut-out portion, the shield member shaped so as to compliment the shape of said cut-out portion. This is advantageous, especially when such a cover is rotatable between the first and second cover positions. The complimentary shape of the shield member helps resist against tampering and vandalism.

If the cover is provided with an edge or edges then the shield member may, in the first shield member position, inhibit access to at least part of the said edge or edges of the cover. The shield member may be provided with shield member edges that abut against or are directly adjacent to said cover edge or edges so as to inhibit access to said cover edge or edges. It is preferred in this case that the cover and shield member together in the first shield member position form a substantially cylindrical structure.

The shield member may be pivotally mounted to one of the upper and lower hinge assembly portions, preferably the lower hinge assembly portion, so as to undergo a pivotal motion between the first and second shield member positions. The shield member may pivot about an axis substantially parallel to said first pivot axis.

It is further preferred that the hinge assembly comprises an additional means for inhibiting the pivotal motion of the upper hinge assembly portion relative to the lower hinge assembly portion. This may comprise a locking pin or bolt that is inserted, for example, through bores in the upper and lower hinge assembly portions so as to inhibit movement. Such an additional means ensures that the upper hinge assembly portion does not accidentally or spontaneously move as soon as the cover is moved into the second position.

The column of the third aspect of the present invention may incorporate those features described with respect to the column of the first aspect of the present invention.

The upper hinge assembly portion may be integral with the upper part of the column, and the lower hinge assembly portion may be integral with the lower part of the column.

In accordance with a fourth aspect of the present invention there is provided a hinge assembly suitable for use in the column of the third aspect of the present invention. The hinge assembly may incorporate the features described above with respect to the column of the third aspect of the present invention.

It is therefore clear that the upper and lower hinge assembly portions do not have to be an integral part of longitudinally extending members that make up a column. For example, the upper and lower hinge assembly portions may comprise tubular inserts that may be attached to longitudinally extending members. The lower hinge assembly portion may, for example, be attached to the lower section of a lamppost and the upper hinge assembly portion may be attached to the upper section of a lamppost. This allows one to convert an unhinged column into a hinged one.

The column of the third aspect of the present invention may form an item of street furniture, such as a lamp post.

In accordance with a fifth aspect of the present invention there is provided a method of fitting a load to a column, the method comprising:

(i) providing a column in a generally upright position, the column comprising an upper part pivotally attached to a lower part at or near one end of the upper part, a removable counterweight being provided at or near the other end of the upper part, the column further comprising a counterbalance mechanism that exerts a force on the upper part to urge the upper part to a straight configuration in which the longitudinal axes of the upper and lower parts are substantially parallel (ii) causing the upper part of the column to pivotally move relative to the lower part (iii) removing said counterweight and (iv) fitting said load onto said column.

The use of a counterweight allows the load to be fitted easily and safely to the column. The load may typically be a lamp or camera. Furthermore, the use of a counterweight allows the counterbalance mechanism to be adjusted so that, when the load is fitted onto the column, minimal or no adjustment of the counterbalance mechanism is required to optimise the hinging motion of the column.

The method preferably further comprises the step of fixing the orientation of the upper and lower part (of the column) relative to one another between steps (ii) and (iii). This prevents unwanted righting of the upper part of the column once the counterweight has been removed. The angle between the longitudinal axes of the lower and upper parts (of the column) in the fixed position may be between about 80 and 110 degrees, preferably between about 90 and 100 degrees and more preferably about 90 degrees. Once the load has been fitted onto the column, then it is preferred that the upper part (of the column) is returned to an upright position.

It is preferred that the counterbalance mechanism is adjustable such that the pivotal motion of the upper part relative to the lower part (of the column) is adjustable, and the method further comprises the step of adjusting the counterbalance mechanism so as to adjust the pivotal motion of the upper part relative to the lower part (of the column). This allows the motion of the upper part (of the column) to be controlled and optimised for a given prospective load. This enables safe and efficient operation of the column once the load is fitted to the column. It is further preferred that the counterbalance mechanism is adjusted such that the pivotal motion of the upper part relative to the lower part corresponds to a predetermined motion. It is further preferred that, on lowering of the upper part (of the column), the upper part comes to rest at a predetermined position relative to the lower part. This allows the user to gently push the upper part when the column is in an unbroken position, and have confidence in the upper part (of the column) coming to rest at a desired orientation relative to the lower part facilitating access to the load (once fitted).

BRIEF DESCRIPTION OF THE DRAWINGS

An embodiment of the invention will now be described by way of example only with reference to the following figures of which:

FIGS. 4*a-d* are perspective views of the hinge portion of an alternative column in accordance with the present invention.

DETAILED DESCRIPTION OF THE PREFERRED EMBODIMENTS

Figure 1:
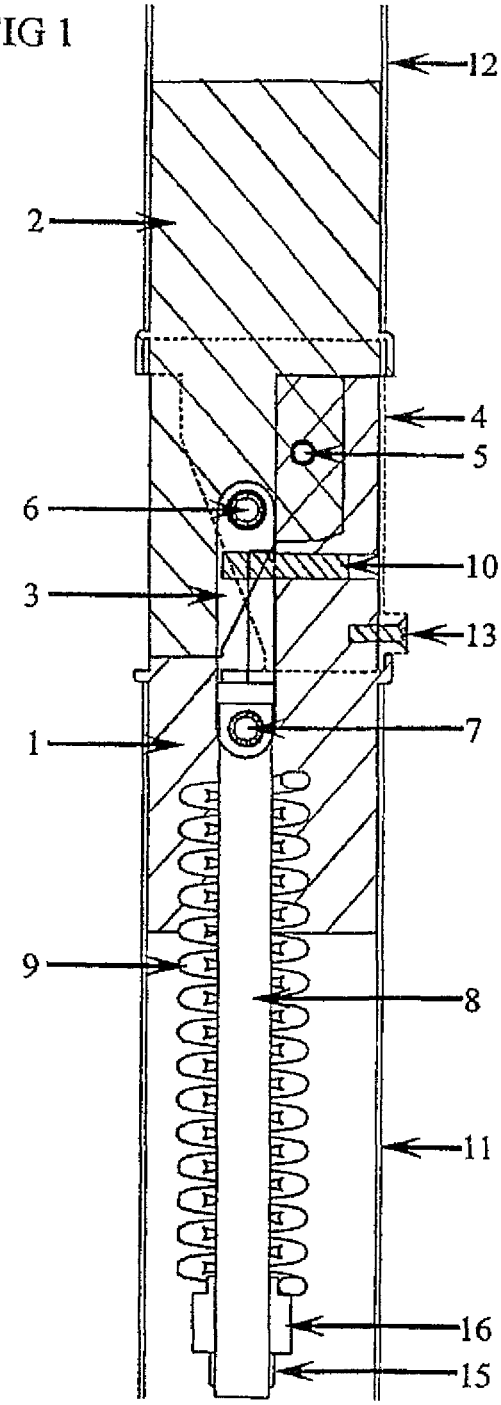
FIG. 1 is a cross-section through the hinge portion of a column in accordance with an embodiment of the present invention.
Figure 2:
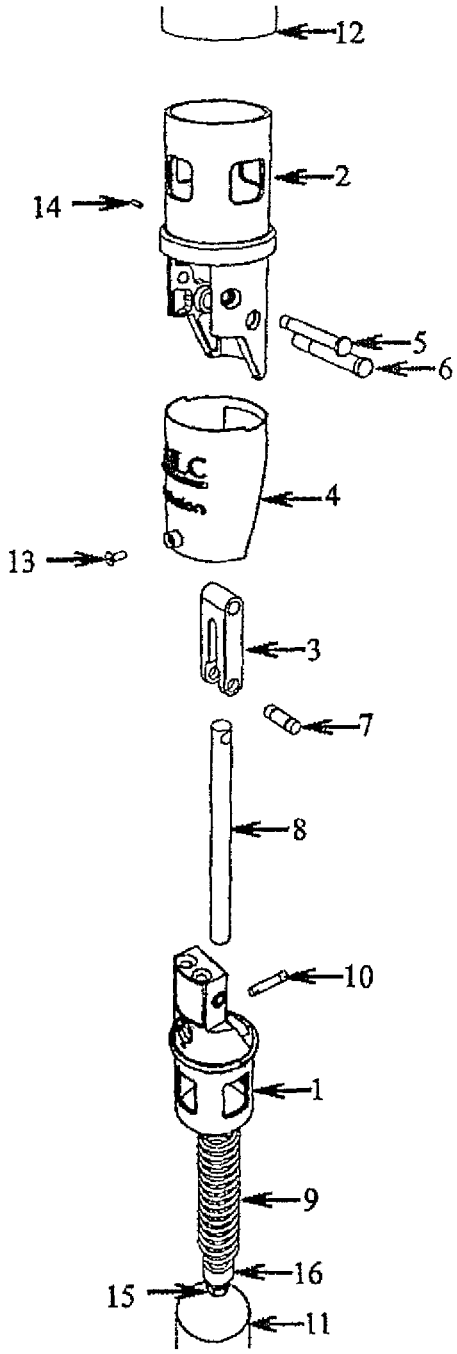
FIG. 2 is an exploded view of the hinge portion of a column in accordance with the embodiment of FIG. 1.

FIGS. 1 and 2 show a hinge portion of a column in accordance with an embodiment of the present invention. The column comprises an upper hinge portion 2 pivotally connected by an axle 5 to a lower hinge portion 1. The upper 2 and lower 1 hinge portions are typically made from a heat-treated case aluminium alloy, such as LM25. The upper hinge portion 2 comprises a substantially tubular upper part that mates with the end of an upper column member 12. The upper column member 12 carries, in this case, a lamp, but may be used to carry other items such as cameras, flags, radio transmitters or receivers. Upper column member 12 is typically made by extrusion of a 6000 series aluminium alloy, such as ISO EN AW-6063 (an Al—Mg—Si alloy). Lower hinge portion 1 comprises a substantially tubular lower part that mates with the upper end of a lower column member 11. Upper hinge portion 2 is pivotally attached to a link arm 3 by a first link arm axle 6. The longitudinal axis of the first link arm axle 6 extends through bore 32 (see FIG. 3) provided in the link arm 3, and is substantially parallel to the axle 5 about which the upper hinge portion 2 pivots. The link arm 3 is generally elongate in shape and typically made from heat treated cast aluminium alloy, such as LM25. The link arm 3 is further pivotally attached to one end of a rod 8 by a second link arm axle 7. The longitudinal axis of the second link arm axle 7 extends through bores 30 and 31 (see FIG. 3) provided in the link arm 3, and is substantially parallel to the axle 5 about which the upper hinge portion 2 pivots. The rod 8 passes through the interior space defined by a helical spring 9 and is provided at its other end with a threaded portion on which is mounted a nut 15. The nut 15 abuts a spring control disk 16. The lengths of the spring 9, rod 8 and spring control disk 16 are arranged to maintain the spring 9 in compression at all times. The position of the nut 15 along the threaded portion of the rod 8 is adjustable so that the degree of compression of the spring 9 is adjustable. FIG. 1 shows the hinged assembly in an unbroken position. In this position, the longitudinal axis of elongated link arm 3 is substantially parallel to the longitudinal axis of the unbroken column. In this position, a locking pin 10 is provided through an aperture in lower hinge portion 1 and into an aperture provided in the link arm 3 (retaining bore 33 in FIG. 3). This resists movement of the upper portion relative to the lower portion because, in the absence of such a locking pin 10, rotation of the upper portion relative to the lower portion from the unbroken position causes link pin 3 to rise. Such motion is resisted by the locking pin 10 being located within retaining bore 33. The longitudinal axis of the elongated locking pin 10 in the present (unbroken) position is substantially orthogonal to the longitudinal axis of axle 5 (the pivotal axis of the upper hinge portion 2). The column is further provided with a sleeve 4 (again typically made from a heat-treated cast aluminium alloy, such as LM25) which is lockable by security bolt 13 to the lower hinge portion 1. The sleeve 4 surrounds the upper 2 and lower 1 hinge portions in the region of the pivoting axle 5. The front portion of the sleeve 4 (that containing the security bolt 13) engages at its top and bottom edges with recesses formed in the upper 2 and lower 1 hinged portions respectively. This helps prevent the upper hinge portion 2 from undergoing pivotal motion with respect to the lower hinge portion 1. The rear portion of the sleeve 4 is defined only by a narrow band of material at the rear and top of the sleeve 4 and therefore is in the form of a relatively open structure at the rear. The sleeve 4 prevents unwanted access to the internal workings of the hinge mechanism. The shape of the upper hinge portion 2 is arranged such that access cannot be made to the internal workings of the hinge mechanism from the rear of the column.

Figure 5:
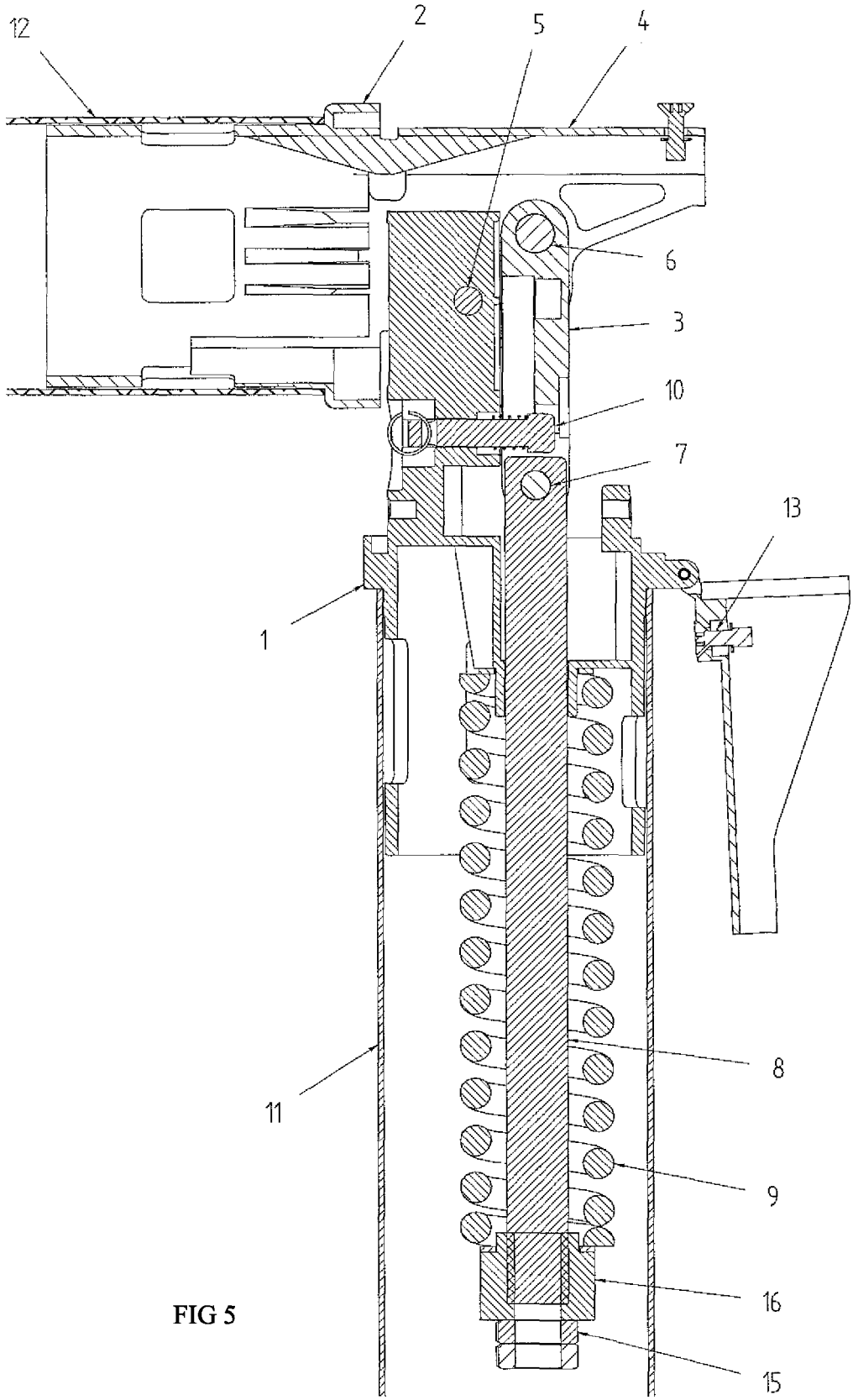
FIG. 5 is a cross-sectional view through the hinge portion of the column illustrating the column in a broken/maintenance position.

The process of "breaking" the column to facilitate simple access to its top will now be described with reference to FIGS. 1, 2, and 5. The countersunk security bolt 13 is removed from the sleeve 4 and the lower hinge portion 1. The sleeve 4 is then rotated about the longitudinal axis of the column by 180 degrees. The upper edge of the sleeve 4 and a groove provided by the upper hinge portion 2 in which the upper edge is located are arranged such that the sleeve may only be rotated in one direction and that rotation is limited to 180 degrees. Once the sleeve 4 has been rotated into this position, it no longer inhibits pivotal motion of the upper hinge portion 2 relative to lower hinge portion 1. This is partially a function of the rearwardly open shape of the sleeve 4. With the sleeve in this position, pivotal motion of the upper hinge portion 2 is still prevented by the locking pin 10 extending through a bore in the lower hinge portion 1 into retaining bore 33. The locking pin 10 is then removed, but the upper hinge portion 2 should not move until a small force is applied to the upper hinge portion 2 or the upper column member 12 because the spring 9 is compressed and should resist movement from the "unbroken" position. Once the hinge has been broken the upper hinge portion 2 moves pivotally relative to the lower hinge portion 1. The pivotal motion causes the first link arm axle 6 (that provides the pivotal attachment between the upper hinge portion 2 and the link arm 3) to move in the direction of the arrow, thus causing the first axle 6 to rise. The link arm 3 is substantially rigid and has a substantially constant length and thus the second link arm axle 7 (that provides the pivotal attachment between the link arm 3 and the rod 8) rises. This causes rod 8 and associated nut 15 and spring control disk 16 to move upwardly in a direction substantially parallel to the longitudinal axis of the rod 8. This compresses the spring 9, thus increasing the resistive force exerted by the spring on the upper hinge portion 2. Hence as the angle between the longitudinal axes of the upper 2 and lower 1 hinge portions increases, the displacement of the link arm 3 increases and so the compression in the spring 9 increases, thus increasing the resistive force that works against the increase in pivotal motion of the upper hinge portion 2 away from the "unbroken" position. This provides a smooth, controlled motion of the upper column member 12 throughout. The compression in the spring 9 can be altered by moving the nut 15 along rod 8 so that the motion of the upper column may be optimized. For example, it is desirable for the upper column member 12 to halt when the upper hinge portion 2 is at a predetermined desired position, typically with its longitudinal axis at about 90 degrees to the longitudinal axis of the lower hinge portion 1. Once the column is in the desired position, then locking pin 10 may be reinserted into the bore provided in the lower hinge portion 1 and into retaining bore 34. The locking pin 10 is then located between the second link arm axle 7 inserted between bores 30, 31 (see FIG. 3) and the lower portion of the link arm 3 as defined by retaining bore 34. This allows a small amount of pivotal motion or "play" of the upper hinge portion 2 which may be advantageous for those working on the column, but prevents the return to the upright, unbroken position. This is desirable, because accidental return to the upright position may cause damage to the column and/or injury to personnel working on the column. Once the locking pin 10 is in position, then work may be commenced on the column without fear of injury or accident associated with righting of the column. Once the necessary work has been performed on the column, then the locking pin 10 may be removed. A small force exerted on the upper column member 12 or the upper hinge portion 2 will then cause the upper hinge portion 2 and upper column member 12 to return to the unbroken position. The compressed spring 9 will act to return the upper hinge portion 2 towards the "unbroken" position. As the motion proceeds towards the "unbroken" position, then the amount of compression in the spring 9 decreases and the force exerted by the spring 9 decreases. This effectively produces a slow, controlled return to the unbroken position.

The use of a single link arm 3 provides a simple and effective, yet strong link between the upper hinge portion 2 and the spring 9. It also facilitates a simple mechanism for locking the hinge assembly in more than one position. Axles 5, 6, 7, locking pin 10 and security bolt 13 are typically made from stainless steel because of this metal's resistance to corrosion.

FIGS. 4*a*-*d* show a perspective view of a the hinge assembly portion of an alternative column in accordance with the present invention. The column and the components labeled operate in essentially the same manner as described with reference to FIGS. 1, 2 and 3, with the exception that the column of FIGS. 4*a*-4*d* is provided with a shield member 40 that, when in position, inhibits access to sleeve 4, therefore reducing the likelihood of sleeve 4 being damaged or removed by vandalism. FIG. 4*a* shows the column in an upright orientation. Sleeve 4 is locked into place by a captured security bolt 13. As mentioned above, the rear section of sleeve 4 is a relatively open structure. The shield member 40 is shaped to complement the open structure of the sleeve 4 so that it is difficult to access the edges of the sleeve 4 that form the open structure, and thus making it more difficult to damage or remove the sleeve 4 by tampering. Shield member 40 and sleeve 4 together form a substantially cylindrical structure that extends around the column so as to inhibit unwanted damage to the sleeve 4 and unwanted access to the internal workings of the column.

Shield member 40 is provided with an aperture (not shown) through which is inserted a security bolt 42 which engages with the lower hinge portion 1 to resist unwanted movement of the shield member 40. In order to move the column to its maintenance position, security bolt 42 is undone to permit pivotal movement of shield member 40 about pivot 41 (FIGS. 4*a* and 4*b*). Once the shield member 40 has been removed, and after removal of security bolt 13, sleeve 4 may be rotated about the longitudinal axis of the column as shown in FIGS. 4*b* and 4*c* by 180°. Once the sleeve 4 has been rotated into this position it no longer inhibits pivotal motion of the upper column member 12 relative to the lower column member 11 and the upper column member 12 may be lowered into the maintenance position (FIG. 4*d*).

Righting of the column after maintenance is now described. The upper column member 12 may be raised from the maintenance position into the upright position as described above with reference to FIGS. 1, 2 and 3. After moving the upper column member 11 into the upright position, sleeve 4 may be rotated from the position shown in FIG. 4*c* by 180° about the longitudinal axis of the column to the sleeve position shown in FIGS. 4*a* and 4*b*. Sleeve 4 may be locked in position using security bolt 13. Shield member 40 is then rotated about pivot 41 to the shield member position shown in FIG. 4*a*, and then locked into position using security bolt 42.

Those skilled in the art will realize that mechanisms other than compression springs may be used to provide a counterbalancing force to control the pivotal movement of the upper hinge portion 2 and upper column member 12. Other arrangements that could be used in lieu of the compression spring include a spring in extension, a gas compression piston, a toothed rack and pinion, weighted ballast, electrical motor, pulley system, gearing system or a winch system.

Those skilled in the art will realize that the upper 12 and lower 11 column members are not essential parts of the present invention. The upper 2 and lower 1 hinged portions may be provided, as in this case, as sleeves or inserts that are attachable to column members. This facilitates the conversion of previously unhinged columns to hinged columns.

Figure 3:
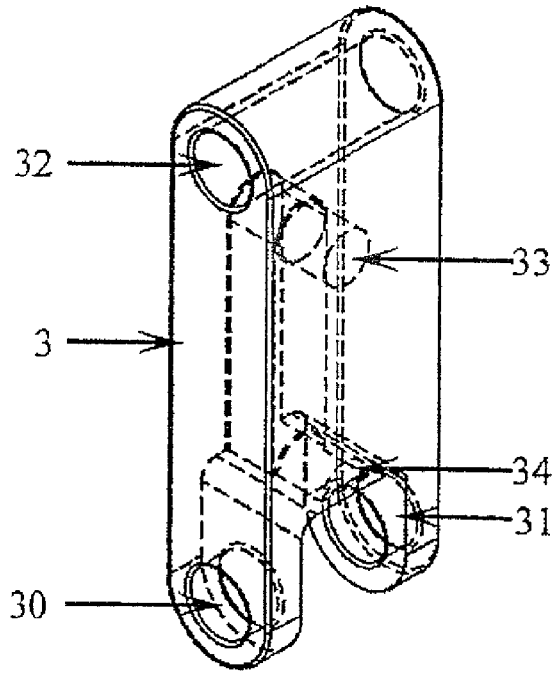
FIG. 3 is a perspective view of a pivot link used in the embodiment of FIGS. 1 and 2.

The column of FIGS. 1, 2 and 3 shows an arrangement whereby the link arm 3 is pivotally attached to the upper hinge portion 2 by a first link arm axle 6 and is pivotally attached to the rod 8 by a second link arm axle 7. The rod 8 passes through the interior space defined by the helical spring 9, the spring 9 being associated with the lower hinge portion 1. Alternatively, the link arm 3 may be pivotally attached to the lower hinge portion 1 by a first link arm axle 6, and may be pivotally attached to the rod 8 by the second link arm axle 7. Again, the rod 8 would pass through the interior space defined by the helical spring 9, but the spring 9 and rod 8 would be associated with the upper hinge portion 2. Such an arrangement would operate in a very similar manner to that shown in FIGS. 1, 2 and 3, but may hinder access to the spring 9. It may be desirable in such an arrangement to invert the hinge assembly in its entirety. In this case, for example, what was the lower hinged portion would effectively become the upper hinge portion and what was the upper hinge portion would become the lower hinge portion cover.

The columns of the present invention may be used as flagpoles, lampposts, signposts, boat masts, advertising banner systems, wing and solar generators, radio and phone mast antennae, masts for closed circuit or other cameras, sports goal posts, security bollards, raised tannoy systems, or any other application where it would be advantageous for columns maintaining high appliances to be hinged.

A load may be fitted to a hinged column, in particular a hinged column in accordance with the present invention, in accordance with a method of the present invention. This method is now described by way of example only with reference to the column of the embodiment of FIGS. 1, 2 and 3.

The hinged column of FIGS. 1 and 2 further comprising a counterweight attached to the upper column member 12 is inserted into suitable foundations in the ground and the foundations, typically concrete, are permitted to set. The column is then broken in accordance with the description above in order to lower the upper column member 12 towards the ground. Once the upper 2 and lower 1 portions of the hinge are in the correct position, the hinge is then locked in this position as described above. This prevents righting of the hinge once the counterweight is removed from the upper column member 12. Cabling (not visible) for a lantern is then fed through the tubular upper column member 12 from an opening (not visible) in the lower column member 11. The counterweight is then removed and the lantern attached to the upper column member 12, ensuring that the lantern is connected to the cabling. The locking pin 10 is removed and the lantern given a gentle push. The column then rights to the unbroken position in accordance with the description above. The locking pin 10 is inserted in the relevant position once the column has returned to the normal, unbroken position. The sleeve 4 is then rotated back to the position in which it resists pivotal motion of the upper hinge portion 2. The sleeve 4 is then secured in position by security bolt 13.

Alternatively, the hinged column in accordance with the present invention may be installed without a counterweight. The hinged column of FIGS. 1 and 2 is inserted into suitable foundations in the ground and the foundations, typically concrete, are permitted to set. The compression in the spring 9 is adjusted such that the weight of the upper column member 12 may cause the upper column member 12 to lower towards the ground once the hinge is "broken". The column is then broken in accordance with the description above in order to lower the upper column member 12 towards the ground. Once the upper 2 and lower 1 portions of the hinge are in the correct position, the upper 2 and lower 1 hinge portions are then locked in this position as described above. Cabling (not visible) for a lantern is then fed through the tubular upper column member 12 from an opening (not visible) in the lower column member 11. The lantern is then attached to the upper column member 12, ensuring that the lantern is connected to the cabling. The locking pin 10 is removed and the column and lantern righted. The locking pin 10 is inserted in the relevant position once the column has returned to the unbroken position. The compression in the spring 9 is then adjusted such that subsequent lowering of the upper column member 12 with the lantern attached is controlled and safe. The sleeve 4 is then rotated back to the position in which it resists pivotal motion of the upper portion 2. The sleeve 4 is then secured in position by security bolt 13.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims.

The invention claimed is:

1. A column comprising a hinge assembly, the hinge assembly including an upper portion pivotally attached to a lower portion for movement about a first pivot axis, the upper portion of the hinge assembly being associated with an upper part of the column and the lower portion of the hinge assembly being associated with a lower part of the column, wherein in use, movement of the upper and lower hinge assembly portions about the first pivot axis from a mutual position, in which the upper part of the column is relatively upright, causes the upper part of the column to rotate towards the lower part of the column, thereby allowing the upper part of the column to be moved to a maintenance position, wherein connecting means links, via second and third pivot axes, the upper and lower portions of the hinge assembly, and the connecting means is associated with bias means that exerts a force via the connecting means, which urges the upper and lower hinge assembly portions towards the normal position, the connecting means comprising a substantially rigid link in the form of a single elongate linking arm, the substantially rigid link being pivotally attached, via a first pivotal attachment for pivoting movement about the second pivot axis, to one of the upper hinge assembly portion and the lower hinge assembly portion, and being pivotally attached, via a second pivotal attachment for pivoting movement about the third pivot axis, to an engagement member associated with the other of the upper hinge assembly portion and the lower hinge assembly portion, the engagement member engaging with the bias means such that the bias means exerts a force via the engagement member and the connecting means, which urges the upper and lower hinge assembly portions towards the normal position the hinge assembly includes a sleeve that is rotatable between a first position in which the sleeve inhibits relative pivotal motion of the upper hinge assembly portion relative to the lower hinge assembly portion and a second position in which the sleeve permits a relative pivotal motion of the upper hinge portion relative to the lower hinge portion, the relative pivotal motion permitted solely by the rotation of the sleeve and a locking mechanism permitting the sleeve to rotate while preventing the relative pivotal motion of the upper hinge assembly portion relative to the lower hinge assembly portion and subsequently permitting the relative pivotal motion, and wherein the upper portion of the hinge assembly and the lower portion of the hinge assembly when in the maintenance position are in approximate 90 degree relationship.

2. The column according to claim 1 wherein the link is elongate and is pivotally attached to one of the upper hinge assembly portion and the lower hinge assembly portion at or near one end of the link, and the link is provided with the second pivotal attachment at or near the other end of the link.

3. The column according to claim 1 wherein the engagement member is rigid and is movable such that, in use, movement of the column in a direction from its normal position to the maintenance position causes movement of the engagement member so as to increase the force which urges the upper and lower hinge assembly portions towards the normal position.

4. The column according to claim 1, wherein the second pivot axis is associated with the upper hinge assembly portion and the third pivot axis is associated with the lower hinge assembly portion.

5. The column according to claim 1 wherein the bias means comprises a compression spring.

6. The column of claim 1 wherein the locking mechanism comprises the substantially rigid link and a locking pin for engaging the substantially rigid link to the lower portion thereby retaining the upper portion in the maintenance position.

7. The column of claim 1 wherein the sleeve is retained in the first position by a fastener retaining the sleeve with respect to the lower portion.

8. The column of claim 1 wherein the rigid link upper part of the column in the normal position cannot pivot and when the second and third pivot axes of the rigid link are moved along a central axis of the column to an extended different position resulting in pivotal movement of the hinge assembly.

9. The column of claim 1 wherein the upper portion is retained in the normal position by the locking mechanism which comprises the substantially rigid link and a locking pin for engaging the link to the lower portion thereby stopping movement of the link and retaining the hinge assembly in the normal position.

10. The column of claim 9 and wherein the pivotal movement is additionally prevented by the sleeve being in the first position.

11. A column comprising a hinge assembly, the hinge assembly including an upper portion pivotally attached to a lower portion for movement about a first pivot axis, the upper portion of the hinge assembly being associated with an upper part of the column and the lower portion of the hinge assembly being associated with a lower part of the column, wherein in use, movement of the upper and lower hinge assembly portions about the first pivot axis from a normal position, in which the upper part of the column is relatively upright, causes the upper part of the column to rotate towards the lower part of the column, thereby allowing the upper part of the column to be moved to a maintenance position, wherein connecting means links, via second and third pivot axes, the upper and lower portions of the hinge assembly, the connecting means is in the form of a substantially rigid single elongate linking arm and is associated with a compression spring that exerts a force via the connecting means, which urges the upper and lower hinge assembly portions towards the normal position the hinge assembly includes a sleeve that is rotatable between a first position in which the sleeve inhibits relative pivotal motion of the upper hinge assembly portion relative to the lower hinge assembly portion and a second position in which the sleeve permits a relative pivotal motion of the upper hinge portion relative to the lower hinge portion, the relative pivotal motion permitted solely by the rotation of the sleeve and a locking mechanism permitting the sleeve to rotate while preventing the relative pivotal motion of the upper hinge assembly portion relative to the lower hinge assembly portion and subsequently permitting the relative pivotal motion, and wherein the upper portion of the hinge assembly and the lower portion of the hinge assembly when in the maintenance position are in approximate 90 degree relationship.

12. The column according to claim 11 wherein the connecting means is pivotally attached, via a first pivotal attachment for pivoting movement about the second pivot axis, to one of the upper hinge assembly portion and the lower hinge assembly portion, and being pivotally attached, via a second pivotal attachment for pivoting movement about the third pivot axis, to an engagement member associated with the other of the upper hinge assembly portion and the lower hinge assembly portion, the engagement member engaging with the compression spring such that the compression spring exerts a force via the engagement member and the connecting means, which urges the upper and lower hinge assembly portions towards the normal position.

13. The column of claim 11 wherein the locking mechanism comprises the substantially rigid link and a locking pin for engaging the substantially rigid link to the lower portion thereby retaining the upper portion in the maintenance position.

14. The column of claim 11 wherein the sleeve is retained in the first position by a fastener retaining the sleeve with respect to the lower portion.

15. The column of claim 11 wherein the rigid link upper part of the column in the normal position cannot pivot and when the second and third pivot axes of the rigid link are moved along a central axis of the column to an extended different position resulting in pivotal movement of the hinge assembly.

16. The column of claim 11 wherein the upper portion is retained in the normal position by the locking mechanism comprising the substantially rigid link and a locking pin for engaging the link to the lower portion thereby stopping movement of the link and retaining the hinge assembly in the normal position.

17. The column of claim 16 and wherein the pivotal movement is additionally prevented by the sleeve being in the first position.

18. A hinge assembly suitable for use in a column, the hinge assembly comprising an upper portion pivotally attached to a lower portion for movement about a first pivot axis, the upper portion of the hinge assembly being, in use, associated with an upper part of the column and the lower portion of the hinge assembly being, in use, associated with a lower part of the column, wherein the upper and lower hinge assembly portions are movable about the first pivot axis between an unbroken position and a broken position, wherein connecting means links, via second and third pivot axes, the upper and lower portions of the hinge assembly, the connecting means being a single elongate rigid linking arm associated with a compression spring that exerts a force via the connecting means, which urges the upper and lower hinge assembly portions towards the unbroken position, the hinge assembly includes a sleeve that is rotatable between a first position in which the sleeve inhibits relative pivotal motion of the upper hinge assembly portion relative to the lower hinge assembly portion and a second position in which the sleeve permits a relative pivotal motion of the upper hinge portion relative to the lower hinge portion, the relative pivotal motion permitted solely by the rotation of the sleeve and a locking mechanism permitting the sleeve to rotate while preventing the relative pivotal motion of the upper hinge assembly portion relative to the lower hinge assembly portion and subsequently permitting the relative pivotal motion, and wherein the upper portion of the hinge assembly and the lower portion of the hinge assembly when in the maintenance position are in approximate 90 degree relationship.

19. The column of claim 18 wherein the locking mechanism comprises a substantially rigid link and a locking pin for engaging the substantially rigid link to the lower portion thereby retaining the upper portion in the maintenance position.

20. The column of claim 18 wherein the sleeve is retained in the first position by a fastener retaining the sleeve with respect to the lower portion.

21. The column of claim 18 wherein the linking arm comprises a rigid link to the upper part of the column and when in the normal position cannot pivot and when the second and third pivot axes of the rigid link are moved along a central axis of the column to an extended different position resulting in pivotal movement of the hinge assembly.

22. The column of claim 18 wherein the upper portion is retained in the normal position by the locking mechanism comprising a substantially rigid link and a locking pin for engaging the link to the lower portion thereby stopping movement of the link and retaining the hinge assembly in the normal position.

23. The column of claim 22 and wherein the pivotal movement is additionally prevented by the sleeve being in the first position.

24. A hinge assembly suitable for use in a column, the hinge assembly comprising an upper portion pivotally attached to a lower portion for movement about a first pivot axis, the upper portion of the hinge assembly, in use, being associated with an upper part of the column and the lower portion of the hinge assembly, in use, being associated with a lower part of the column, wherein the upper and lower hinge assembly portions are movable about the first pivot axis between an unbroken position and a broken position, wherein connecting means links, via second and third pivot axes, the upper and lower portions of the hinge assembly, and the connecting means is associated with bias means that exerts a force via the connecting means, which urges the upper and lower hinge assembly portions towards the unbroken position, the connecting means comprising a substantially rigid link, the substantially rigid link being pivotally attached, via a first pivotal attachment for pivoting movement about the second pivot axis, to one of the upper hinge assembly portion and the lower hinge assembly portion, and being pivotally attached, via a second pivotal attachment for pivoting movement about the third pivot axis, to an engagement member associated with the other of the upper hinge assembly portion and the lower hinge assembly portion, the engagement member engaging with the bias means such that the bias means exerts a force via the engagement member and the connecting means, which urges the upper and lower hinge assembly portions towards the unbroken position, the hinge assembly includes a sleeve that is rotatable between a first position in which the sleeve inhibits relative pivotal motion of the upper hinge assembly portion relative to the lower hinge assembly portion and a second position in which the sleeve permits a relative pivotal motion of the upper hinge portion relative to the lower hinge portion, the relative pivotal motion permitted solely by the rotation of the sleeve and a locking mechanism permitting the sleeve to rotate while preventing the relative pivotal motion of the upper hinge assembly portion relative to the lower hinge assembly portion and subsequently permitting the relative pivotal motion, and wherein the upper portion of the hinge assembly and the lower portion of the hinge assembly when in the maintenance position are in approximate 90 degree relationship.

25. The column of claim 24 wherein the locking mechanism comprises the substantially rigid link and a locking pin for engaging the substantially rigid link to the lower portion thereby retaining the upper portion in the maintenance position.

26. The column of claim 24 wherein the sleeve is retained in the first position by a fastener retaining the sleeve with respect to the lower portion.

27. The column of claim 24 wherein the rigid link to the upper part of the column and when in the normal position cannot pivot and when the second and third pivot axes of the rigid link are moved along a central axis of the column to an extended different position resulting in pivotal movement of the hinge assembly.

28. The column of claim 24 wherein the upper portion is retained in the normal position by the locking mechanism comprising the substantially rigid link and a locking pin for engaging the link to the lower portion thereby stopping movement of the link and retaining the hinge assembly in the normal position.

29. The column of claim 28 and wherein the pivotal movement is additionally prevented by the sleeve being in the first position.

* * * * *

UNITED STATES PATENT AND TRADEMARK OFFICE

CERTIFICATE OF CORRECTION

PATENT NO. : 8,584,993 B2
APPLICATION NO. : 10/592485
DATED : November 19, 2013
INVENTOR(S) : Pumford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1312 days.

Signed and Sealed this
Twenty-second Day of September, 2015

Michelle K. Lee

Michelle K. Lee
*Director of the United States Patent and Trademark Office*